US009387475B2

(12) United States Patent
Van't Oever et al.

(10) Patent No.: US 9,387,475 B2
(45) Date of Patent: Jul. 12, 2016

(54) ASSEMBLY OF AT LEAST ONE MICROFLUIDIC DEVICE AND MOUNTING PIECE

(75) Inventors: Ronny Van't Oever, Deventer (NL); Marko Theodoor Blom, Enschede (NL)

(73) Assignee: Micronit Microfluidics B.V., Enschede (NL)

( * ) Notice: Subject to any disclaimer, the term of this patent is extended or adjusted under 35 U.S.C. 154(b) by 1393 days.

(21) Appl. No.: 12/439,780

(22) PCT Filed: Aug. 31, 2007

(86) PCT No.: PCT/NL2007/000214

§ 371 (c)(1),
(2), (4) Date: Jun. 16, 2009

(87) PCT Pub. No.: WO2008/030088

PCT Pub. Date: Mar. 13, 2008

(65) Prior Publication Data

US 2010/0239462 A1 Sep. 23, 2010

(30) Foreign Application Priority Data

Sep. 4, 2006 (NL) ..... 1032425

(51) Int. Cl.
*G01N 33/00* (2006.01)
*B01L 3/00* (2006.01)

(52) U.S. Cl.
CPC ..... *B01L 3/502715* (2013.01); *B01L 3/502707* (2013.01); *B01L 3/5635* (2013.01); *B01L 2200/027* (2013.01); *B01L 2200/0642* (2013.01); *B01L 2300/0645* (2013.01)

(58) Field of Classification Search
USPC ..... 422/68.1, 500, 501, 502, 503, 504, 505, 422/506, 507, 82.02; 137/487.5; 436/43, 436/174, 180
See application file for complete search history.

(56) References Cited

U.S. PATENT DOCUMENTS

| | | | | |
|---|---|---|---|---|
| 5,498,392 | A * | 3/1996 | Wilding et al. | 422/68.1 |
| 8,480,971 | B2 | 7/2013 | Kawazoe et al. | |
| 2003/0214057 | A1 * | 11/2003 | Huang | 264/1.1 |
| 2005/0106752 | A1 * | 5/2005 | Yu et al. | 436/174 |
| 2005/0112036 | A1 * | 5/2005 | Funazaki et al. | 422/130 |
| 2005/0176059 | A1 | 8/2005 | Pal et al. | |
| 2009/0041624 | A1 | 2/2009 | Hochmuth et al. | |

FOREIGN PATENT DOCUMENTS

| | | | |
|---|---|---|---|
| EP | 1424559 | A1 | 6/2004 |
| EP | 1520838 | A1 | 4/2005 |
| EP | 1832861 | A1 | 9/2007 |
| WO | 0109598 | A1 | 2/2001 |
| WO | 2006059649 | A1 | 6/2006 |
| WO | 2006072405 | A1 | 7/2006 |
| WO | WO 2007016931 | A1 * | 2/2007 |

* cited by examiner

*Primary Examiner* — In Suk Bullock
*Assistant Examiner* — Sharon Pregler
(74) *Attorney, Agent, or Firm* — The Webb Law Firm

(57) ABSTRACT

An assembly comprising at least one microfluidic device and a mounting piece, this microfluidic device comprising at least one material layer and at least one first fluidic port, which first fluidic port it situated at least partially in an end surface of the material layer and which mounting piece comprises at least one fluidic component, wherein the mounting piece is coupled to the microfluidic device by means of first coupling means provided for this purpose such that the fluidic component is connected to the first fluidic port. The invention also relates to such a mounting piece.

14 Claims, 3 Drawing Sheets

ASSEMBLY OF AT LEAST ONE MICROFLUIDIC DEVICE AND MOUNTING PIECE

FIELD OF THE INVENTION

The invention relates to an assembly of at least one microfluidic device and a mounting piece, the microfluidic device comprising at least one material layer and at least one first fluidic port and the mounting piece comprising at least one fluidic component, wherein the mounting piece is coupled to the microfluidic device by means of first coupling means provided for this purpose such that the fluidic component is connected to the first fluidic port. In the context of the invention 'microfluidic device' is understood to mean: 'microstructural device with a fluidic function'. Within the scope of the invention 'microstructural device' is defined in the usual manner as "device including at least one essential element or formation characterised by its very small size, typically within the range of $10^{-4}$ to $10^{-7}$ meters, i.e. its significant features can not, in at least one dimension, be completely discerned without the use of an optical microscope", see also the notes under IPC class B81.

BACKGROUND TO THE INVENTION

Microfluidics is concerned with microstructural devices and systems with fluidic functions. This may involve the manipulation of very small quantities of fluid, i.e. liquid or gas, in the order of microliters, nanoliters or even picoliters. Important applications lie in the field of biotechnology, chemical analysis, medical testing, process monitoring and environmental measurements. A more or less complete miniature analysis system or synthesis system can herein be realized on a microchip, a so-called 'lab-on-a-chip' or, in specific applications, a so-called 'biochip'. The device or the system can comprise microfluidic components such as microchannels, microtunnels or microcapillaries, mixers, reservoirs, diffusion chambers, pumps, valves and so forth.

The microchip is usually built up of one or more layers of glass, silicon or a plastic such as a polymer. Glass in particular is very suitable for many applications because of a number of properties. Glass has been known for many centuries and there are many types and compositions readily available at low cost. In addition, glass is hydrophilic, chemically inert, stable, optically transparent, non-porous and suitable for prototyping; properties which are in many cases advantageous or required.

In determined applications a microchip has to be connected to one or more reservoirs or wells. For this purpose the reservoirs are for instance manufactured separately and then, for instance by means of glueing or clamping, arranged on the microchip at the position of fluidic inlets or outlets arranged for this purpose in the 'upper surface' of the microchip, for example EP-A-1 424 559, EP-A-1 520 838, WO-A-2006/072 405, US-A-2005/176 059 and WO-A-01/09 598. The drawback is that the reservoirs and the possible seals occupy a relatively large part of the 'upper surface' of the microchip, thereby limiting the maximum density of inlets and outlets and the compactness of the device. In addition, the reservoirs and the possible seals may be 'in the way' during visual inspection or for instance during optical, electrical or other measurements. Wells are sometimes also arranged directly in the 'upper surface' of the microchip, generally as powder-blasted or drilled holes. The above stated drawbacks then also apply, and furthermore the additional process of powder-plastering or drilling is then necessary. The volume of the reservoirs is moreover limited by the low height of the reservoirs, in principle a maximum of the thickness of the microchip, as a result of the character of the microchips, which is by definition planar.

There is therefore a need for a solution, which does not have the above stated drawbacks, for the connection of one or more fluidic components, in particular reservoirs or wells, to one or more fluidic inlets or outlets of a microfluidic device or system. The invention has for its object to fulfil this need.

SUMMARY OF THE INVENTION

The invention provides for this purpose a system comprising at least one microfluidic device and a mounting piece, this microfluidic device comprising at least one material layer and at least one first fluidic port, which first fluidic port is situated at least partially in an end surface of the material layer and which mounting piece comprises at least one fluidic component, wherein the mounting piece is coupled to the microfluidic device by means of first coupling means provided for this purpose such that the fluidic component is connected to the first fluidic port. 'End surface' is understood here and in the following to mean a surface which bounds the relevant material layer extending perpendicularly of its thickness direction, in a direction perpendicularly of this thickness direction. In other words, it is a 'side surface' with a relatively small surface area, and therefore not an 'upper surface' or a 'lower surface' with a relatively large surface area. 'Connect' is understood here and in the following to mean that a fluidic connection is made which is direct or optionally indirect, for instance via a valve. 'Port' is understood here and in the following to mean an inlet or outlet. A connection of the fluidic component or components to the first fluidic port or ports can thus be realized with a correct design of the mounting piece and by coupling the mounting piece in a correct manner to the microfluidic device or devices.

The 'upper surface' of the microfluidic device can herein be left largely clear so that sufficient space remains, for instance for visual inspection and optical, electrical or other measurements. If this is not essential, the 'upper surface' of the microfluidic device can be minimized so that the microchips can be smaller and more microchips can be manufactured per batch and per process run, at lower cost per chip. This will all be further elucidated in the following description of exemplary embodiments of an assembly according to the invention.

Coupling can for instance take place by means of a clamp connection, a snap connection, a melt connection or a glued connection or in other suitable manner. The mounting piece can comprise for this purpose a receiving space for receiving a part of the microfluidic device. A component for the purpose of an operation on the microfluidic device, which component forms part of the mounting piece, can thus also be aligned relative to the microfluidic device by means of the first coupling means. Here and in the following 'operation' is understood to mean a for instance electrical, optical, magnetic, electromagnetic, thermal, fluidic or chemical detection or actuation such as a reading, measurement, control or driving.

The mounting piece preferably consists at least partially of plastic. Plastics are readily available in many types and can generally be brought into a desired form in relatively simple manner. It is moreover simple to select a plastic with a suitable elasticity and surface roughness, for instance for a clamp connection or a snap connection, so that no adhesive or the like is required. The microfluidic device can be built up of one or more layers of glass, silicon or a plastic such as a polymer.

As stated, said materials are frequently applied in microfluidic devices owing to their suitable properties.

The fluidic component forming part of the mounting piece can be a reservoir, a fluidic conduit or a second fluidic port. The fluidic component can, for instance in the case of a reservoir, also be connected to a plurality of first ports, which first ports in turn can form part of for instance a single microchip or of different microchips. For instance in the case that the mounting piece is coupled to a plurality of microfluidic devices, connections of the one microfluidic device to the other can also be made via one or more fluidic conduits forming part of the mounting piece. Fluidic components forming part of the mounting piece can for instance also be mutually connected by means of fluidic conduits provided for this purpose in the mounting piece. All such options, variants and combinations thereof fall within the scope of the invention.

The microfluidic device can comprise a component and the mounting piece can comprise a component, which components make contact after coupling of the microfluidic device and mounting piece. Here and in the following 'component' is understood to mean a for instance electrical, optical, magnetic, electromagnetic, thermal or chemical, passive or active element, such as an electrode or an optical waveguide. 'Make contact' is understood here and in the following to mean that the relevant components are connected such that exchange of mass, charge, radiation or energy is possible, for instance in the form of an electric current or a light current. The mounting piece can comprise a component which can make contact with a fluid present in the fluidic component. The microfluidic device can also comprise a component which can make contact with a fluid present in the fluidic component. An electrical potential can for instance thus be applied to the fluid or a current can be measured. This may for instance be important in an analysis where use is made of capillary electrophoresis.

An assembly according to the invention can also comprise a connector, which connector is coupled to the microfluidic device by means of second coupling means provided for this purpose and which connector comprises a component, wherein the microfluidic device also comprises a component and the components make contact. Non-fluidic, in particular electrical connections, to the microfluidic device can thus also be made by means of the connector. The component forming part of the connector can herein make contact with a fluid present in the fluidic component by means of the component forming part of the microfluidic device. Contact can thus be made via the connector with fluid in the mounting piece. The connector can also comprise a component for the purpose of an operation on the microfluidic device, which can be aligned relative to the microfluidic device by means of the second coupling means.

BRIEF DESCRIPTION OF THE FIGURES

The invention is elucidated hereinbelow on the basis of three non-limitative exemplary embodiments of an assembly according to the invention. Herein.

EXEMPLARY EMBODIMENTS OF AN ASSEMBLY AND A MOUNTING PIECE ACCORDING TO THE INVENTION

Figure 1:
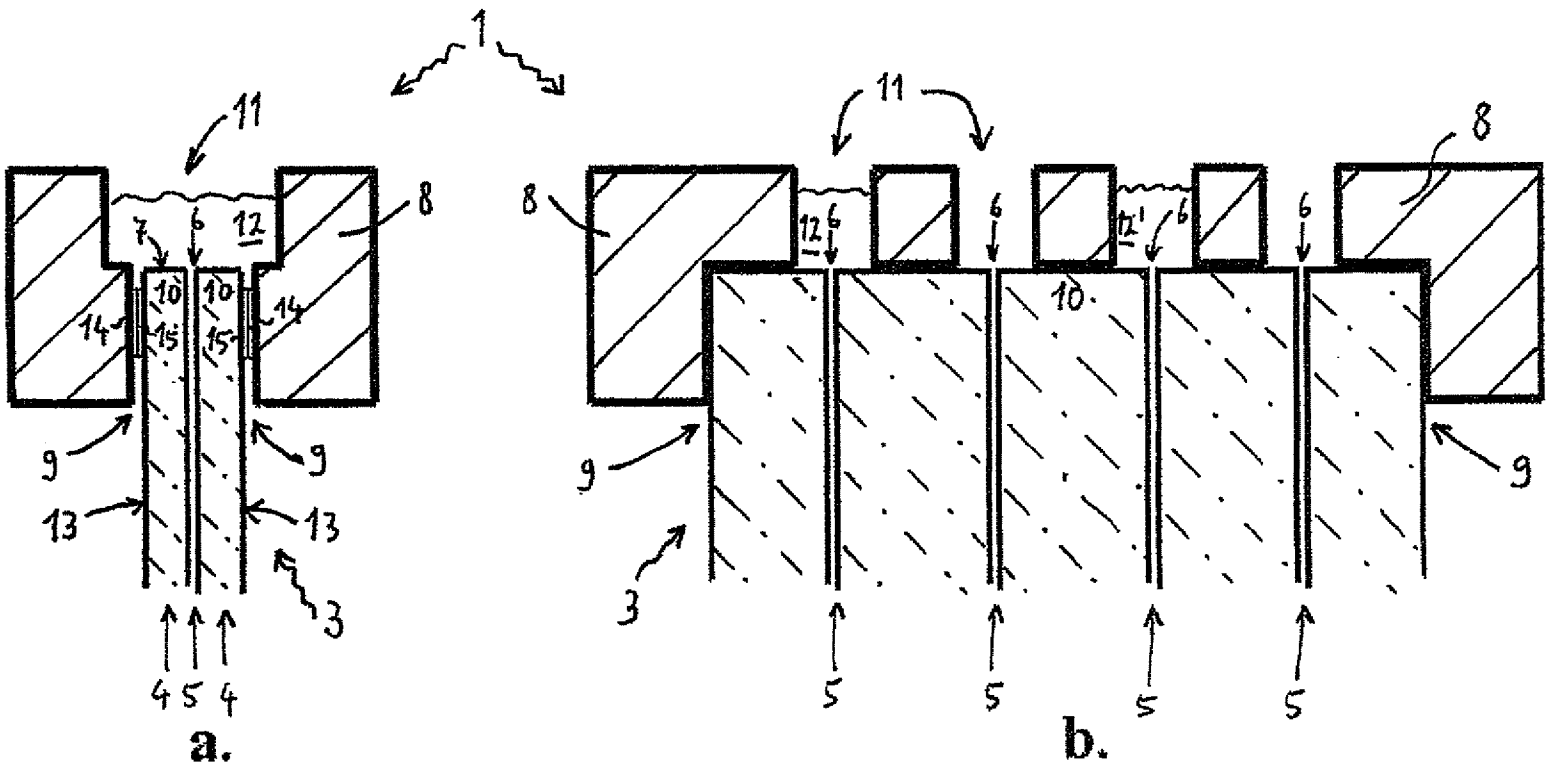
FIG. 1*a* shows a more or less schematic partial cross-section of a first exemplary embodiment of an assembly according to the invention comprising a microfluidic device and a mounting piece.
FIG. 1*b* shows a more or less schematic partial longitudinal section thereof.

FIG. 1 shows a schematic outline of a part of a first exemplary embodiment of an assembly 1 of a microfluidic device or microchip 3 and a mounting piece 8 according to the invention. Microchip 3 is built up of two layers of glass 4 between which, according to known techniques, a number of microtunnels 5 is arranged which connect to ports 6 in end surfaces 7 of glass layers 4. The remaining part (not shown) of microchip 3 can, in accordance with the application, comprise other microtunnels, networks, mixers, reservoirs, diffusion chambers, pumps, valves, integrated electrodes, electrical circuits and so forth, this as will be apparent to a skilled person. Mounting piece 8 is provided with a receiving space (9) in which an edge 10 of microchip 3 with ports 6 is received and clamped. Mounting piece) also comprises spaces 1 which serve as reservoirs or wells for liquids 12, 12' such as samples, reagents or carriers. Microchip 3 lies here with its 'upper surface' and 'lower surface' 13 in vertical position so that liquids 12, 12' will remain in the reservoirs or wells 11 open to the top.

The mounting piece is provided with electrodes (14) which, after coupling of mounting piece (8) to microchip (3), make contact with electrodes (15) arranged on microchip (3). These electrodes (15) can in turn also be connected (not shown) to components (not shown) arranged on or in microchip (3), which components can thus be electrically controlled, powered, measured or read.

By coupling mounting piece (8) to the edge (10) of microchip (3) space remains available on the 'upper surface' and 'lower surface' (13), for instance for visual inspection of microtunnels (5) or other parts (not shown), or for instance for electrical or optical measurements.

Figure 2:
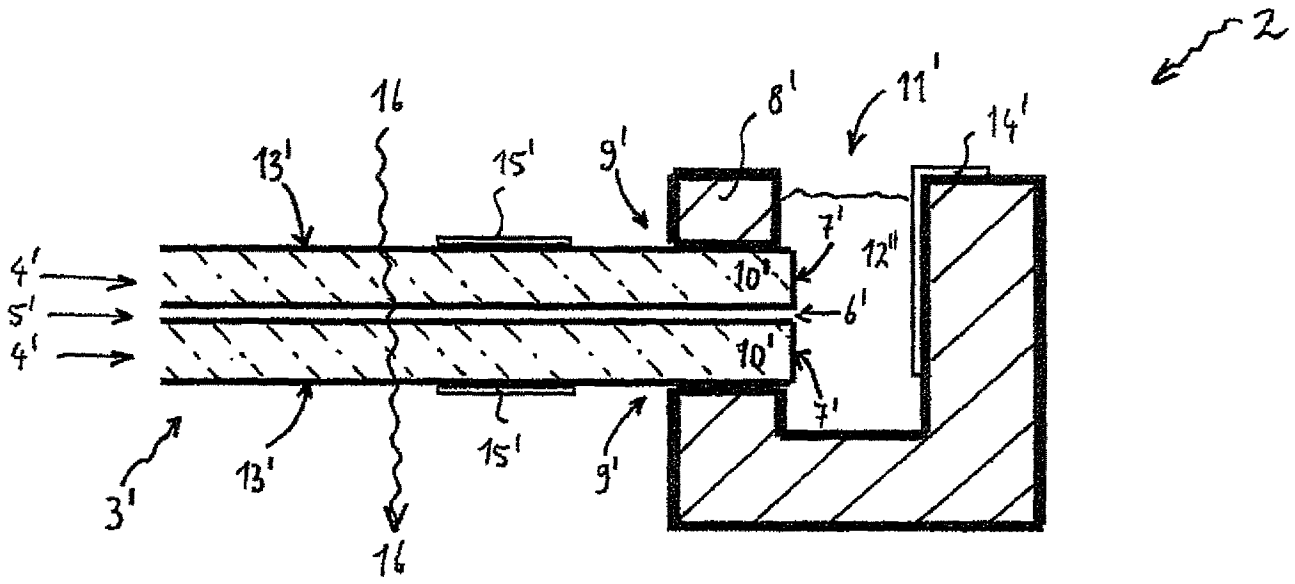
FIG. 2 shows a more or less schematic partial cross-section of a second exemplary embodiment of an assembly according to the invention comprising a microfluidic device and a mounting piece.

FIG. 2 shows a schematic outline of a part of a second exemplary embodiment of an assembly (2) of a microfluidic device or microchip (3') and a mounting piece (8') according to the invention. Microchip (3') is once again built up of two layers of glass (4') between which a number of microtunnels (5') is arranged which in turn connect to ports (6') in end surfaces (7') of glass layers (4'). Mounting piece (8') again comprises spaces (11') which served as reservoirs or wells for liquids (12") such as samples, reagents or carriers, here however in a different orientation. Microchip (3') now lies here with its 'upper surface' and 'lower surface' (13') horizontal so that liquids (12") will remain in the reservoirs or wells (11') open to the top. Such a position of microchip (3') may be desirable or required in specific cases, for instance during inspection with an optical microscope.

The mounting piece is provided with electrodes (14') which are in contact with the liquids (12") in reservoirs or wells (11'). In specific applications, for instance in the case of measurements where electrokinetic phenomena are a factor, an electrical voltage can thus be applied to the liquids (12") in reservoirs or wells (11'), or the electrical potential thereof can be determined.

By coupling mounting piece (8') to the outer end (10') of microchip (3') space once again remains available on 'upper surface' and 'lower surface' (13'), for instance for visual inspection of microtunnels (5') or other parts (not shown), or for instance for electrical or optical measurements. An electrical measurement can thus take place, for instance by means of electrodes (15') provided on microchip (3'), for instance a dielectric measurement or detection. Nor in this configuration does the mounting piece (8') form an obstruction to for instance an optical measurement (16) on for instance liquid present in microtunnels (5').

Figure 3:
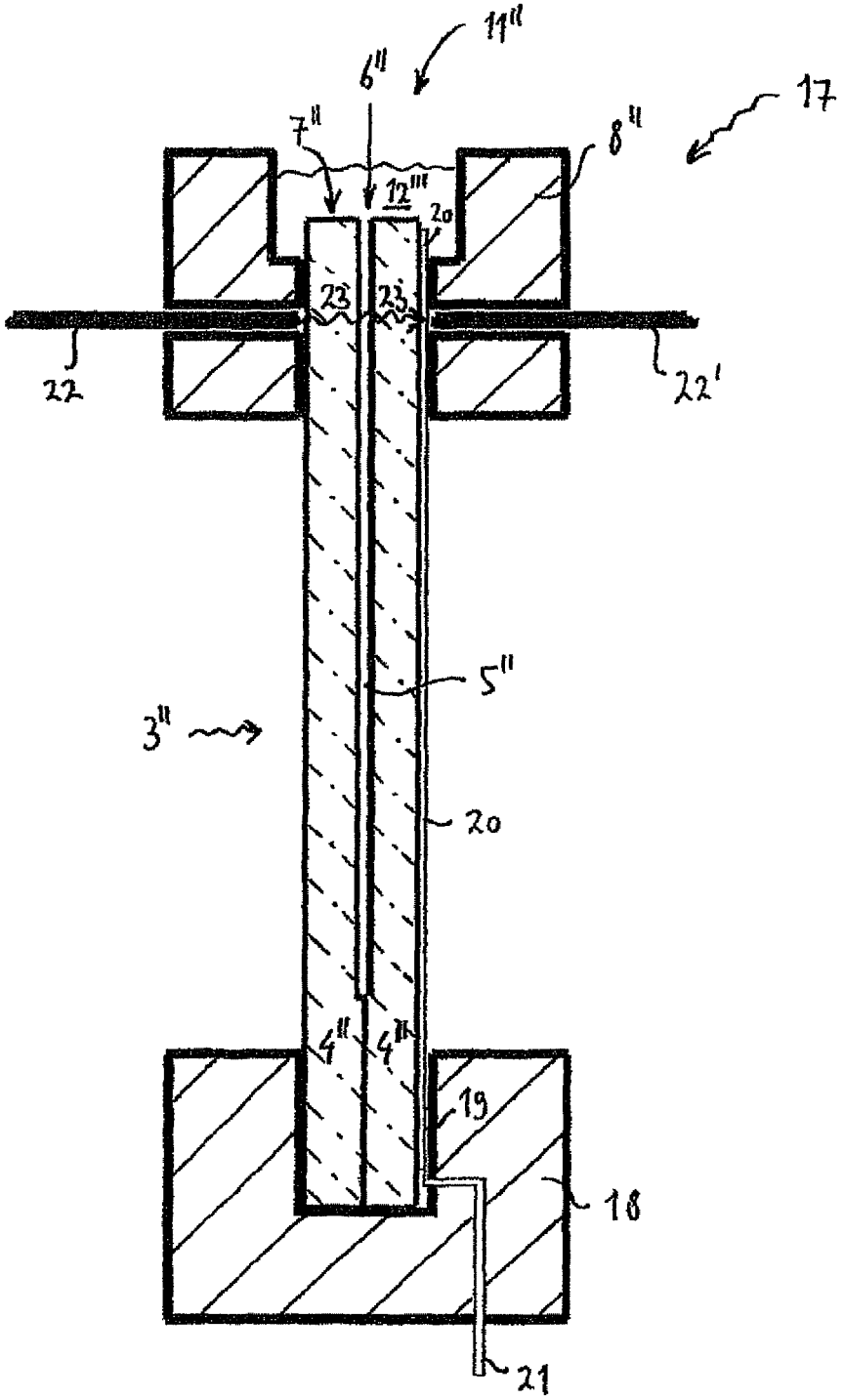
FIG. 3 shows a more or less schematic cross-section of a third exemplary embodiment of an assembly according to the invention comprising a microfluidic device, a mounting piece and a connector.

FIG. 3 shows a schematic outline of a third exemplary embodiment of an assembly (17) of a microfluidic device or microchip (3") and a mounting piece (8") and a connector (18) according to the invention. This is once again a microchip (3") built-up of two layers of glass (4") between which a number of microtunnels (5") is arranged which again connect to ports (6") in end surfaces (7") of glass layers (4"). Mounting piece (8") once again comprises spaces (11") which serve as reservoirs or wells for liquids (12''') such as samples, reagents or carriers.

The assembly now also comprises a connector (18) which is provided with electrodes (19) which are connected to contact pins (21) provided for this purpose and which, after coupling of connector (8), make contact with electrodes (20) forming part of microchip (3"). The electrodes (20) forming part of microchip (3") can make contact with a liquid (12''') present in a reservoir (11"). Contact can thus be made via the connector or contact pins (21) with liquids (12") present in reservoirs (11").

Mounting piece (8") is also provided with optical components or optical wave-guides (22,22') which are automatically aligned relative to microchip (3") during coupling of mounting piece (8") to microchip (3") and with which an optical operation, for instance a measurement or control, can be performed on microchip (3").

It will be apparent that the invention is by no means limited to the given exemplary embodiments, but that many variants are possible within the scope of the invention. In addition to being electrical and optical, the described components and operations can thus, as stated, also be for instance of magnetic, electromagnetic, thermal, fluidic or chemical nature. The fluidic components forming part of the mounting piece can for instance also be conduits or second ports. These fluidic components can be connected to a plurality of first ports which in turn can form part of for instance a single microchip or of different microchips. The mounting piece can also be coupled to a plurality of microfluidic devices, wherein connections from the one microfluidic device to the other are for instance made. Fluidic components in the mounting piece can for instance also be mutually connected by means of fluidic conduits, and so on and so forth. As stated, all such options, variants and combinations thereof fall within the scope of the invention.

What is essential is that external fluidic components, in particular reservoirs or wells, are not connected, as is usual, to ports in the 'upper surface' of a microchip, but to ports in an outer end or side surface thereof, and that more space thereby remains available on the 'upper surface' and 'lower surface' of the microchip, for instance for visual inspection or other operations, or that the 'upper surface' and 'lower surface' of the microchip can thereby be smaller and the device or the system can thus be given a more compact form. Furthermore, an additional process such as powder-blasting or drilling is then often no longer necessary.

The invention claimed is:

1. An assembly of at least one microfluidic device and a mounting piece, the microfluidic device comprising a substantially planar material layer extending in x- and y-directions of the microfluidic device, wherein the substantially planar material layer has a thickness in a z-direction of the microfluidic device, and at least one first fluidic port situated at least partially in an end surface of the substantially planar material layer, wherein the normal of the end surface is in the x- or y-direction, and the mounting piece comprising at least one fluidic component, wherein the mounting piece is coupled to the microfluidic device by a first coupling means provided for this purpose such that the fluidic component is connected to the first fluidic port, and wherein the first coupling means comprises a receiving space in the mounting piece in which an edge of the microfluidic device with the at least one first fluidic port is received and coupled thereto by a clamp connection, a snap connection, a melt connection or a glued connection; and wherein the first coupling means comprises a fluidic seal which is at least partially arranged on the end surface of the substantially planar material layer.

2. The assembly as claimed in claim 1, wherein the fluidic component is one of a reservoir, a fluidic conduit, and a second fluidic port.

3. The assembly as claimed in claim 1, wherein the microfluidic device includes a component and the mounting piece includes a component, and said components make contact.

4. The assembly as claimed in claim 1, wherein the mounting piece includes a component which can make contact with a fluid present in the fluidic component.

5. The assembly as claimed in claim 1, wherein the microfluidic device includes a component which can make contact with a fluid present in the fluidic component.

6. The assembly as claimed in claim 1, wherein the mounting piece includes a component for the purpose of an operation on the microfluidic device.

7. The assembly as claimed in claim 6, wherein the first coupling means includes alignment means for aligning the component relative to the microfluidic device.

8. The assembly as claimed in claim 1, wherein the assembly further comprises a connector which is coupled to the microfluidic device by means of second coupling means provided for this purpose and which connector comprises a component, and the microfluidic device comprises a component and said components make contact.

9. The assembly as claimed in claim 8, wherein the component forming part of the connector can make contact with a fluid present in the fluidic component by means of the component forming part of the microfluidic device.

10. The assembly as claimed in claim 8, wherein the connector includes a component for the purpose of an operation on the microfluidic device.

11. The assembly as claimed in claim 10, wherein the second coupling means includes alignment means for aligning the component relative to the microfluidic device.

12. The assembly as claimed in claim 1, wherein the substantially planar material layer includes two layers of glass between which a plurality of microtunnels are arranged.

13. An assembly of at least one microfluidic device and a mounting piece, the microfluidic device comprising a sheet of material disposed in x- and y-directions of the microfluidic device, wherein the sheet of material has an upper surface disposed in the x- and y-directions, a lower surface disposed in the x- and y-directions and a thickness in a z-direction of the microfluidic device, and wherein the sheet of material has a plurality of microtunnels therein for moving fluids perpendicularly to the z-direction and a plurality of fluidic ports connecting to the plurality of microtunnels, wherein the plurality of fluidic ports are situated at least partially in an end surface of the sheet of material, the end surface being defined as a boundary of the microfluidic device in the y-direction, and wherein the plurality of fluidic ports are respectively arranged along the x-direction of the end surface, the mounting piece comprising a plurality of fluidic components, wherein the mounting piece is coupled to the microfluidic device such that the plurality of fluidic components are connected to the plurality of fluidic ports, and wherein the mounting piece comprises a receiving space in the mounting piece in which an edge of the microfluidic device with the plurality of fluidic ports is received and coupled thereto by a clamp connection, a snap connection, a melt connection or a glued connection; and wherein the mounting piece is coupled to the microfluidic device by a fluidic seal which is at least partially arranged on the end surface of the substantially planar material layer.

14. The assembly as claimed in claim 13, wherein the sheet of material includes two layers of glass between which the plurality of microtunnels are arranged.

* * * * *